US009138856B2

(12) United States Patent
Feldmann et al.

(10) Patent No.: US 9,138,856 B2
(45) Date of Patent: Sep. 22, 2015

(54) METHOD AND APPARATUS FOR SURFACE STRENGTHENING AND/OR SMOOTHING OF AN INTEGRALLY BLADED ROTOR AREA OF A JET ENGINE

(75) Inventors: Goetz G. Feldmann, Oberursel (DE); Oleksandr Kyrylov, Frankfurt (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 654 days.

(21) Appl. No.: 13/447,894

(22) Filed: Apr. 16, 2012

(65) Prior Publication Data

US 2012/0266426 A1 Oct. 25, 2012

(30) Foreign Application Priority Data

Apr. 19, 2011 (DE) ..... 10 2011 007 705

(51) Int. Cl.

| | |
|---|---|
| ***B24B 1/00*** | (2006.01) |
| ***B24B 31/00*** | (2006.01) |
| ***B24B 31/06*** | (2006.01) |
| *B24B 31/02* | (2006.01) |

(52) U.S. Cl.

CPC ..... *B24B 31/003* (2013.01); *B24B 31/064* (2013.01); *B24B 31/0224* (2013.01); *Y10T 29/47* (2015.01)

(58) Field of Classification Search

CPC ..... B24B 31/0224
USPC ..... 29/90.01, 90.5; 451/104, 106, 113, 36
See application file for complete search history.

(56) References Cited

U.S. PATENT DOCUMENTS

| | | | | |
|---|---|---|---|---|
| 1,833,025 | A * | 11/1931 | Langenberg | 29/90.01 |
| 2,720,730 | A * | 10/1955 | Kroger | 451/113 |
| 8,220,769 | B2 * | 7/2012 | Mainville et al. | 248/646 |
| 2007/0107217 | A1 * | 5/2007 | Baus et al. | 29/889.1 |

(Continued)

FOREIGN PATENT DOCUMENTS

| | | |
|---|---|---|
| DE | 102009021582 | 12/2010 |
| DE | 102009043574 | 3/2011 |
| EP | 0494305 | 7/1992 |

(Continued)

OTHER PUBLICATIONS

European Search Report dated Jul. 16, 2012 for counterpart European patent application.
German Search Report dated Nov. 10, 2011 from related application.

*Primary Examiner* — Christopher Besler
*Assistant Examiner* — Steven A Maynard
(74) *Attorney, Agent, or Firm* — Timothy J. Klima; Shuttleworth & Ingersoll, PLC

(57) ABSTRACT

The present invention describes a method and an apparatus for surface strengthening and/or smoothing of an integrally bladed rotor area of a jet engine. The rotor area can be connected to a device and held by the latter inside the container in a position equivalent to an at least approximately horizontal orientation of a rotary axis of the rotor area. A space delimited by the container and the rotor area between a surface of the rotor area and that surface of the container facing the rotor area is filled at least partially with strengthening and/or smoothing elements. A relative movement is generated between the surface of the rotor area and the strengthening and/or smoothing elements. The surface region of the rotor area to be strengthened and/or smoothed is at a distance from the surface of the container facing the rotor area.

3 Claims, 2 Drawing Sheets

(56) References Cited

U.S. PATENT DOCUMENTS

Figure 1:
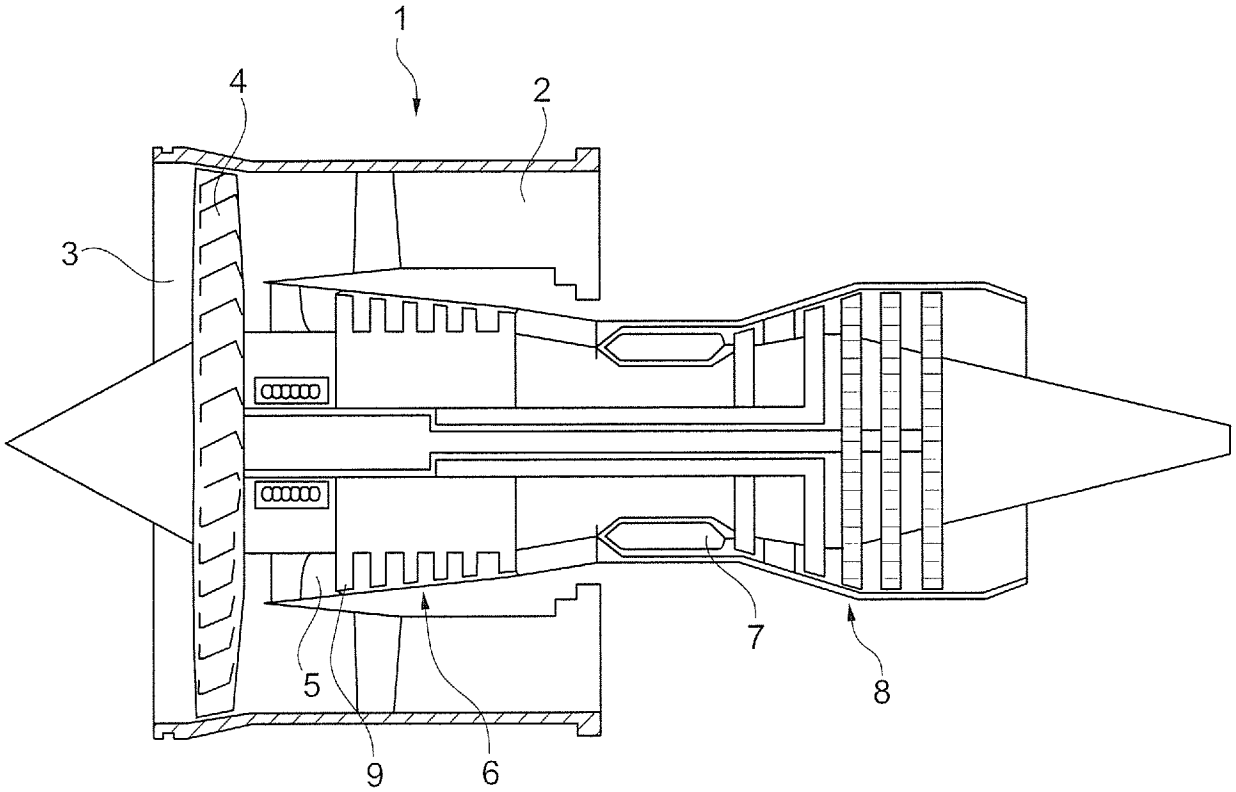

| | | | | |
|---|---|---|---|---|
| 2008/0296469 | A1* | 12/2008 | Mainville et al. | 248/554 |
| 2010/0287772 | A1 | 11/2010 | Hennig et al. | |

FOREIGN PATENT DOCUMENTS

| | | |
|---|---|---|
| EP | 1731262 | 12/2006 |
| EP | 2251140 | 11/2010 |

* cited by examiner

METHOD AND APPARATUS FOR SURFACE STRENGTHENING AND/OR SMOOTHING OF AN INTEGRALLY BLADED ROTOR AREA OF A JET ENGINE

This application claims priority to German Patent Application DE102011007705.7 filed Apr. 19, 2011, the entirety of which is incorporated by reference herein.

This invention relates to a method and an apparatus for surface strengthening and/or smoothing of an integrally bladed rotor area of a jet engine.

A method and an apparatus for surface strengthening and smoothing of metallic components, in particular of rotors or rotor drums with integral blading for aircraft engines, are known from DE 10 2009 021 582 A1. The metallic components are each strengthened and smoothed, or exclusively smoothed, in one working step inside a receptacle filled with strengthening elements and/or abrasive elements and performing a vibratory movement, by a relative movement between the component surface and the strengthening elements.

To do so, a workpiece to be treated is fastened in the interior of the receptacle or container by a device, and the container or abrasion vessel is then filled with a medium or with strengthening elements for abrasion and/or polishing and/or strengthening. Again following on from the process step of filling the container, the workpiece to be treated and the container are jointly set into vibration by an eccentrically mounted drive, as a result of which the abrasive medium arranged inside a space delimited by the container and the component to be treated, or the strengthening and/or smoothing elements arranged therein, are moved. In doing so, a relative movement between the surface of the rotor area and the strengthening and/or smoothing elements is generated. The medium acts continuously on the surface of the component to be treated, with a smoothing and/or strengthening and/or deburring being achieved by material removal and/or material reshaping in the region of the surface of a component to be treated.

Current jet engines of aircraft are increasingly being designed with larger and/or longer sub-assemblies or rotor areas, respectively, manufactured from several individual areas connected to one another by electron beam welding or friction welding. The rotor areas having large component dimensions in the axial direction are arranged upright inside the container of a plant by means of known systems for surface strengthening and smoothing and then set into vibration jointly with the container, whereby the abrasive medium provided between the container and the rotor area to be treated is moved relative to the surface of the rotor area and the surface of the blade elements connected thereto. The vertical arrangement of the rotor areas requires a high filling level of the abrasive medium in order to simultaneously treat the entire surface of a rotor area.

A drawback of this is that the treatment result varies according to the filling level of the strengthening and smoothing elements, since the weight force applied increasingly over the filling level, in particular in the region of the lower abrasive and smoothing elements, alters the relative movement between the surface of the rotor area and the strengthening and smoothing elements or the abrasive medium, respectively. This fact leads to a rotor area not being treatable to the same extent over its axial length, and for example to a material removal and/or a reduction of the surface roughness and/or an introduction of internal compressive stresses in surface-near regions of the rotor area varying to an unwelcome extent over the axial length of a rotor area. Additionally, there is a possibility, particularly in respect of the filling level in the lower regions of a rotor area, that the weight force applied by the abrasive medium at the rotor area causes unwelcome deformations in the region of a rotor area, particularly bending of blade elements, which can only be rectified again by expensive subsequent treatments of rotor areas.

To reduce the influence of the filling level on the treatment result, in known systems a component or rotor area to be treated, and arranged upright inside the container during treatment, is turned around after a defined duration of treatment, and the treatment process is then continued.

This turning around of the workpiece to be treated inside the container does however represent an additional production step which prolongs a treatment time of the workpiece to an unwelcome extent and assures a uniform treatment quality of the rotor area only to a limited extent.

The object underlying the present invention is therefore to provide a method and an apparatus for surface strengthening and/or smoothing of an integrally bladed rotor area of a jet engine by means of which a surface of a rotor area can be treated to the required extent within short process times and with repeatable treatment quality.

It is a particular object of the present invention to provide solution to the above problems by a method and an apparatus designed in accordance with the features described herein.

With the method for surface strengthening and/or smoothing of an integrally bladed rotor area of a jet engine in accordance with the invention, the rotor area is arranged inside a container, and a space delimited by the container and the rotor area between the surface of the rotor area and that surface of the container facing the rotor area is filled at least partially with strengthening and/or smoothing elements, and a relative movement is generated between the surface of the rotor area and the strengthening and/or smoothing elements.

In accordance with the invention, a rotary axis of the rotor area is arranged at least approximately horizontally inside the container during surface strengthening and/or smoothing of the rotor area, and a surface region of the rotor area to be strengthened and/or smoothed is at a distance from a surface of the container facing the rotor area.

Due to the at least approximately horizontal arrangement of the rotor area inside the container or inside the conventionally operating abrasive finishing vessel, a rotor area is treated uniformly over its entire surface. This results from the fact that the factor influencing the strengthening and/or smoothing result, i.e. the filling level of the abrasive medium or of the strengthening and/or smoothing elements, respectively, and resultant partial flow differences between the surface of the rotor area and the strengthening and/or smoothing elements due to the horizontal arrangement of the rotor area inside the container and the resultant low filling level of the strengthening and/or smoothing elements, are eliminated.

In addition, it is possible by means of the method in accordance with the invention, depending on the size of the container and the capacity of a mounting of the rotor area inside the container, to treat sub-assemblies which are large and/or designed with great length in the axial direction, or even several sub-assemblies simultaneously.

In an advantageous variant of the method in accordance with the invention, the relative movement between the surface of the rotor area and the strengthening and/or smoothing elements is generated by a forced rotation of the rotor area relative to the container. The result of this is that the rotor area inside the container does not have to be completely covered by strengthening and/or smoothing elements and fewer strengthening and/or smoothing elements are needed for filling the system.

If, alternatively to this, the relative movement between the surface of the rotor area and the strengthening and smoothing elements is generated by a forced vibration of the rotor area and preferably of the container, deformations of, in particular, blade elements of a rotor area due to a force applied by the strengthening and/or smoothing elements during rotation of the rotor area can be avoided in a simple manner.

If the relative movement between the surface of the rotor area and the strengthening and/or smoothing elements is generated additionally to the rotation of the rotor area relative to the container by a forced vibration of the rotor area and preferably of the container, treatment times of a rotor area can be reduced due to the superimposed relative movement between the surface of the rotor area and the strengthening and/or smoothing elements, said relative movement resulting from the rotation of the rotor area relative to the container and from the vibration of the rotor area and preferably of the container.

With a further variant of the method in accordance with the invention that ensures easy handling of the rotor area, the rotor area is connected, in a substantially vertical orientation of the rotor axis of the rotor area, to a device holding the rotor area in the horizontal position inside the container and then moved into the at least approximately horizontal position inside the container.

If surface strengthening and/or smoothing of the rotor area is performed without material removal in the region of the surface of the rotor area, rotor areas manufactured from different materials can be treated simultaneously.

If a material removal takes place in the region of the surface of the rotor area during surface strengthening and/or smoothing of the rotor area, the latter is provided after treatment with an even better surface quality in comparison with surface strengthening and/or smoothing of the rotor area without material removal, thereby further improving resistance to changing stresses, foreign object damage, crack formation and crack propagation as well as the aerodynamic properties.

With the apparatus in accordance with the invention for surface strengthening and/or smoothing of an integrally bladed rotor area of a jet engine with a device for holding the rotor area inside a container to which the rotor area can be connected, the rotor area can be held by the device in a position equivalent to an at least approximately horizontal orientation of the rotary axis of the rotor area.

Hence a rotor area with a substantially lower filling level of the strengthening and/or smoothing elements in comparison with an apparatus known from the state of the art can be treated over its entire surface at least approximately uniformly within short process times, since the drawbacks resulting from a high filling level are eliminated in a simple manner due to lower weight forces acting on the strengthening and/or smoothing elements, and additional process steps prolonging process times to an unwelcome extent are avoided.

With an advantageous embodiment of the apparatus in accordance with the invention, a drive unit is provided by means of which the rotor area can be set into rotation in its position inside the container equivalent at least approximately to the horizontal orientation of the rotary axis, in order to generate in a simple manner a relative movement between the surface of the rotor area and the strengthening and/or smoothing elements provided for treatment inside the container and at the same time to allow treatment of the rotor area with a low filling level of the strengthening and/or smoothing elements, since, due to rotation, the rotor area does not have to be completely covered by strengthening and/or smoothing elements.

If a drive unit is provided by means of which the rotor area in its position inside the container equivalent at least approximately to the horizontal orientation of the rotary axis, and preferably the container itself, can be subjected to a vibration, a relative movement can be generated between the surface of the rotor area and the strengthening and/or smoothing elements arranged inside the container.

In a further embodiment of the apparatus in accordance with the invention simplifying the handling of the rotor area, the latter can be connected to the device in a position equivalent to an at least approximately vertical orientation of the rotary axis of the rotor area, and moved by the device into its position inside the container equivalent to an at least approximately horizontal orientation of the rotary axis of the rotor area.

Both the features stated in the patent Claims and the features stated in the following embodiment of the subject matter of the invention are each suitable, singly or in any combination with one another, to develop the subject matter of the invention. The respective feature combinations do not represent any restriction with regard to the development of the subject matter in accordance with the invention, but have substantially only an exemplary character.

Figure 2:
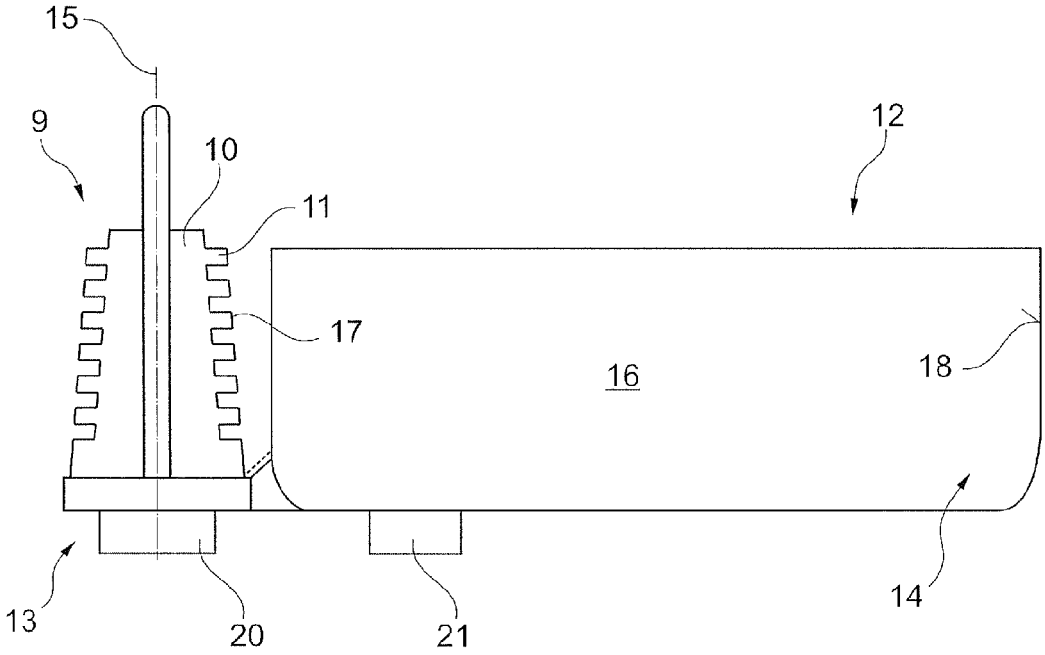
Figure 3:
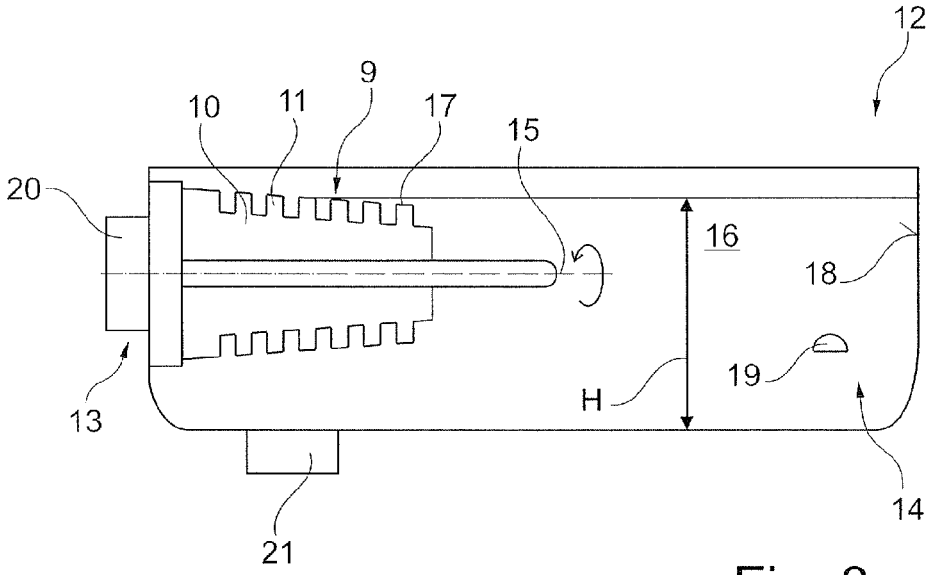

Further advantages and advantageous embodiments of the subject matter of the invention become apparent from the patent Claims and the exemplary embodiment described in principle in the following with reference to the accompanying drawing. In the drawing, FIG. 1 shows a highly schematized longitudinal sectional view of a jet engine provided with an integrally bladed rotor area, FIG. 2 shows a simplified representation of an apparatus for surface strengthening and/or smoothing of the rotor area of the jet engine in accordance with FIG. 1 during a first process phase, and FIG. 3 shows a representation of the apparatus during a second process phase, according to FIG. 2.

FIG. 1 shows a longitudinal sectional view of a jet engine 1 designed with a bypass duct 2. Furthermore, the jet engine 1 is designed with an inlet area 3 adjoined downstream by a fan 4 in a manner known per se. Again downstream of the fan 4, the fluid flow in the jet engine 1 splits into a bypass flow and a core flow, with the bypass flow flowing through the bypass duct 2 and the core flow into an engine core 5, which is designed once again in a manner known per se with a compressor arrangement 6, a burner 7 and a turbine arrangement 8.

The one-piece rotor area 9 includes several blisk areas connected to one another by electron beam welding or friction welding or bolting and arranged next to one another in the axial direction, each representing an integrally bladed rotor design. The term blisks is composed of the words "blade" and "disk". Rigidly connected disks or rigidly connected annular base bodies 10, respectively, of the rotor area 9 as well as several blade elements 11 distributed over the circumference of the base bodies 10 are each made in one-piece, removing the need for blade roots and disk slots provided on multi-piece rotor areas. The one-piece rotor area 9 is distinct from conventionally bladed compressor rotors by a significant decrease in the number of components and the disk shape of the annular base bodies 10 is designed for lower rim loads. In combination with the use of lighter materials, this results in a weight saving of the one-piece rotor area 9 of up to 50 percent compared to conventional rotor areas. The amount of weight saving is in each case dependent on the geometry of the compressor arrangement 6.

A further positive effect is that the blade elements 11 of the integrally bladed rotor area 9 can be arranged more closely to each other, thereby enabling best possible compression and enhancement of efficiency.

In order to provide the compressor arrangement 6 or, respectively, the one-piece rotor area 9 with high resistance to foreign object damage and also vibratory loading while at the same time keeping the weight low, as well as the surface of the rotor area 9 with a minimum roughness to achieve good aerodynamic properties and the highest possible efficiency of the jet engine 1, the rotor area 9 is treated by means of an apparatus 12 shown in greater detail in FIG. 2, where during the treatment of the rotor area 9 a simultaneous surface strengthening and smoothing in the manner described in greater detail in the following can also be performed, besides surface strengthening or surface smoothing.

The apparatus 12 for surface strengthening and/or smoothing of the integrally bladed rotor area 9 includes a device 13 for holding the rotor area 9 inside a container 14. To do so, the rotor area 9 can be connected to the device 13 in the manner shown in greater detail in FIG. 2 in an at least approximately vertical orientation of a rotary axis 15 of the rotor area 9 and held in the manner shown in FIG. 3 by said device 13 in a position inside the container 14 equivalent to an at least approximately horizontal orientation of the rotary axis 15 of the rotor area 9.

This means that the rotor area 9 is initially connected outside the container 14 to the device 13 in a position equivalent to an at least approximately vertical orientation of the rotary axis 15 of the rotor area 9 or in a position shown in greater detail in FIG. 2 and then swivelled using the device 13 into its position equivalent to the at least approximately horizontal orientation of the rotary axis 15 of the rotor area 9 inside an interior 16 of the container 14, with a surface region 17 of the rotor area 9 to be strengthened and/or smoothed being at a distance from a surface 18 of the container 14 facing the rotor area 9 and delimiting the interior 16 in the horizontal position of the rotor area 9.

Then the interior 16 of the container 14 is, depending on the respective application, filled up to a defined filling level H with strengthening and/or smoothing elements 19, which are then arranged inside a space delimited by the container 14 and the rotor area 9 between the surface 17 of the rotor area 9, and that surface 18 of the container 14 facing the rotor area 9.

The device 13 is assigned a drive unit 20 by means of which the rotor area 9 in its position inside the container 14 equivalent at least approximately to the horizontal orientation of the rotary axis 15 can be set into rotation in order to generate between the surface of the rotor area 9 and the strengthening and/or smoothing elements 19 a relative movement and to strengthen and/or smooth the surface 17 of the rotor area 9.

if the strengthening and/or smoothing elements 19 have at least in some areas a spherical form, the surface 17 of the rotor area 9 can be treated in a so-called ball pressure polishing process. During said ball pressure polishing process, two basic main effects occur. One effect is the improvement of the surface quality or the roughness of the surface 17, respectively, of the rotor area 9, which is not done abrasively. A second main effect is the imparting of internal compressive stresses into a surface-near edge region of the rotor area 9 or a strengthening of a surface-near edge layer of the rotor area 9, in order to improve the fatigue strength of the rotor area 9. The rotor area 9 inside the device 12 is here simultaneously treatable in the region of its complete surface 17.

It is additionally possible to impart a vibration to the rotor area 9 in its position inside the container 14 equivalent at least approximately to the horizontal orientation of the rotary axis 15 and also to the container 14 by a further drive unit 21, in order to generate the relative movement between the surface 17 of the rotor area 9 and the strengthening and/or smoothing elements 19 by a forced vibration of the rotor area 9 and of the container 14 and to achieve a strengthening of the surface and/or a smoothing of the surface of the rotor area 9.

LIST OF REFERENCE NUMERALS

1 Jet engine
2 Bypass duct
3 Inlet area
4 Fan
5 Engine core
6 Compressor arrangement
7 Burner
8 Turbine arrangement
9 One-piece rotor area
10 Base body
11 Blade elements
12 Apparatus
13 Device
14 Container
15 Rotary axis of rotor area
16 Interior of container
17 Surface region of rotor area
18 Surface of container
19 Strengthening and smoothing elements
20 Drive unit
21 Further drive unit

What is claimed is:

1. An apparatus for at least one chosen from surface strengthening and smoothing of an integrally bladed rotor of a jet engine, comprising:

a container filled with at least one chosen from non-abrasive strengthening and smoothing elements to a specified height, the at least one chosen from non-abrasive strengthening and smoothing elements having, at least in some areas, a spherical form;

a device for holding the rotor inside the container to which the rotor can be connected, the device constructed and arranged to hold the rotor in a position inside the container equivalent to an at least approximately horizontal orientation of a rotary axis of the rotor;

a rotation drive unit by which the rotor can be set into rotation in its position inside the container equivalent at least approximately to the horizontal orientation of the rotary axis, wherein the specified height is sufficient to contact an entirety of the rotor as the rotor rotates in the container;

a vibration drive unit for vibrating the strengthening and smoothing elements positioned around the rotor in its position inside the container equivalent at least approximately to the horizontal orientation of the rotary axis, the vibration drive unit and rotation drive unit creating a relative motion between the at least one chosen from non-abrasive strengthening and smoothing elements and the rotor to at least one chosen from strengthen and smooth the rotor in a non-abrasive manner without material removal.

2. The apparatus in accordance with claim 1, wherein the device is constructed and arranged to receive the rotor in a position equivalent to an at least approximately vertical orientation of the rotary axis of the rotor, and move the rotor to its position inside the container equivalent to the at least approximately horizontal orientation of the rotary axis of the rotor.

3. The apparatus in accordance with claim 2, wherein the vibration drive unit also vibrates the container.

* * * * *